United States Patent [19]

Kosmahl

[11] 4,277,721

[45] Jul. 7, 1981

[54] MULTISTAGE DEPRESSED COLLECTOR FOR DUAL MODE OPERATION

[75] Inventor: Henry G. Kosmahl, Olmsted Falls, Ohio

[73] Assignee: The United States of America as represented by the Administrator of the National Aeronautics and Space Administration, Washington, D.C.

[21] Appl. No.: 73,579

[22] Filed: Sep. 7, 1979

[51] Int. Cl.[3] ..... H01J 23/02

[52] U.S. Cl. ..... 315/5.38; 315/3.6

[58] Field of Search ..... 315/3.5, 3.6, 5.38

[56] References Cited

U.S. PATENT DOCUMENTS

| | | | |
|---|---|---|---|
| 2,610,306 | 9/1952 | Touraton et al. | 315/5.38 X |
| 3,644,778 | 2/1972 | Mihran et al. | 315/5.38 |
| 3,702,951 | 11/1972 | Kosmahl | 315/5.38 |
| 3,764,850 | 10/1973 | Kosmahl | 315/5.38 |

*Primary Examiner*—Saxfield Chatmon, Jr.
*Attorney, Agent, or Firm*—Norman T. Musial; John R. Manning; James A. Mackin

[57] ABSTRACT

The object of the invention is to provide a depressed collector which captures the spent electrons of a microwave transmitting tube at high efficiency in both high and low power modes of operation.

The collector comprises entrance and end electrodes (14 and 18, respectively), electrode (18) having a spike extending toward entrance electrode (14). Intermediate electrodes (15, 16 and 17) and the entrance electrode (14) each have a central aperture and, together, these electrodes capture most high power mode spent electrons. The apertures of the electrodes (14–17) increase in size in a downstream direction.

To capture low power mode spent electrons a low power mode electrode (19) is positioned between the last intermediate electrode (17) and the end electrode (18). This electrode (19) has a central aperture preferably smaller but no larger than that of electrode (17). An auxiliary low power mode electrode 20 may be disposed between electrodes 19 and 18 and has a central aperture larger than that of the low power mode electrode (20).

All of the electrodes 14–20 are at voltages provided by a voltage divider 21 connected between a potential as at a negative terminal (21) and a common ground return 23.

22 Claims, 2 Drawing Figures

MULTISTAGE DEPRESSED COLLECTOR FOR DUAL MODE OPERATION

DESCRIPTION

1. Technical Field

This invention relates to multistage depressed collectors for microwave transmitting tubes and is directed more particularly to a collector which has high efficiency in either a high power mode of operation or a low power mode of operation.

Many modern microwave transmitting systems require that the radio frequency (RF) power amplifiers in the output of the transmitting systems be capable of dual modes of operation, that is, a high power mode (HPM) during some periods and a low power mode (LPM) at other times. The power level of these two modes may differ by from three decibels (db) to fifteen db.

It is, of course, highly desirable to operate at the highest possible efficiency in each mode particularly in space satellites and for electronic countermeasure applications. In power amplifiers such as traveling wave tubes (TWT), the intrinsic electronic efficiency of the high power mode is always much higher than that of the low power mode. Typically, the electronic efficiency of a TWT without a depressed collector is from about 15 to 25% in the HPM but only 3 to 5% in the LPM. These efficiencies may be substantially increased by injecting spent electrons of the TWT into a multistage depressed collector (MDC).

2. Background Art

The prior art, U.S. Pat. No. 3,702,951 discloses a high efficiency multistage depressed collector for use with a source of charged particles such as spent electrons. Each electrode plate of the collector has a central aperture with the apertures increasing in diameter in a downstream direction from the source of charged particles. The electrode plates are generally bowed toward the source of charged particles with the final electrode plate being conical and having a spike extending toward the source of charged particles.

U.S. Pat. No. 3,644,778 also discloses a multistage depressed collector. The electrode plates of this collector are tapered or slope radially inwardly away from the source of spent electrons. The end electrode includes a spike while a shield electrode having a relatively small aperture surrounds the spike near its base.

The collectors of both of the above described patents are designed to operate only in a high power mode.

In the prior art, to design a TWT depressed collector which could be used in both high and low power modes, it was necessary to make compromises because of the large differences in the average energies, axial velocities and annular spread of spent electrons injected into the collector from the TWT. Such compromises preclude achieving a desired collector efficiency of 80% in the high power mode and an efficiency of at least 90% in the low power mode.

DISCLOSURE OF INVENTION

In accordance with the present invention there is provided for a dual mode TWT, a multistage depressed collector wherein a central aperture in each of a plurality of electrode plates is of greater diameter than the aperture of a preceding upstream electrode plate except for the next to the last electrode which is a low power mode electrode and which has an aperture preferably smaller but not larger than that of the preceding plate.

The last or end electrode has a spike extending toward the TWT. An auxiliary low power mode electrode may be disposed between the dual function electrode and the end electrode and has a central aperture larger than that of the low power mode electrode. A portion of the spike of the end electrode may extend through the aperture of the low power mode electrode.

When the source of spent electrons is operated in a high power mode, only a few fast electrons will pass through the respective apertures in the low power mode electrode and the auxiliary low power electrode. However, in the low power mode, most of the spent electrons will pass through the aperture of the low power mode electrode and a substantial number of those will pass through the aperture of the auxiliary low power mode electrode. This results in a collector efficiency which is very high in both the high power mode of operation and the low power mode of operation.

BRIEF DESCRIPTION OF DRAWINGS

The details of the invention will be described in connection with the accompanying drawings in which.

BEST MODE FOR CARRYING OUT THE INVENTION

Figure 1:
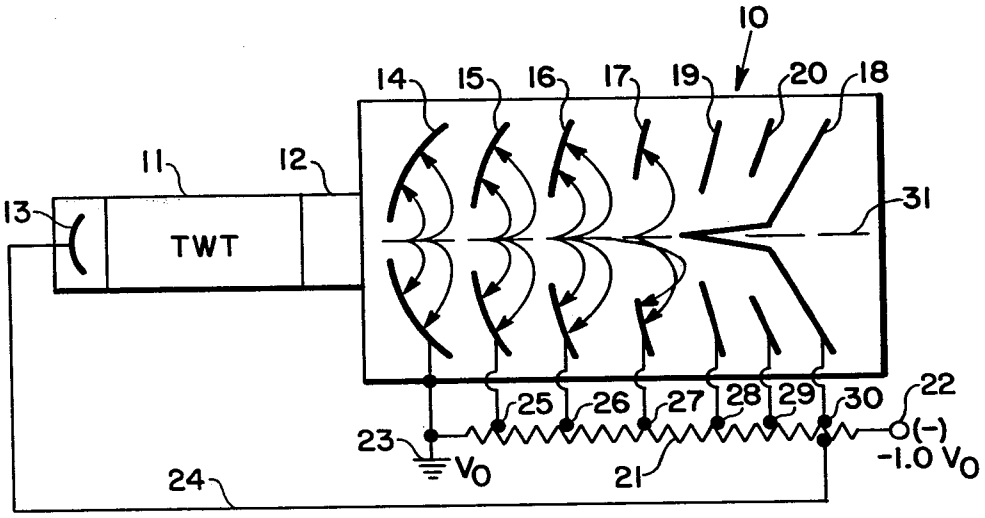
FIG. 1 is a longitudinal sectional view of a collector embodying the invention with the source of spent electrons being shown schematically.

Referring first to FIG. 1, there is shown a multistage depressed collector 10 with a source of spent electrons such as a traveling wave tube (TWT) 11. The TWT 11 may be of the type including a refocusing magnet 12 and having a cathode 13 which provides electrons for the TWT.

Collector 10 is comprised of a plurality of axisymmetric electrode plates 14, 15, 16 and 17 together with a downstream end electrode 18. Each of the electrodes 14 through 17 have a central aperture with the aperture of 15 being of significantly greater diameter than the aperture of 14; the aperture of 16 being of significantly greater diameter than the aperture of 15; and the aperture of 17 being of significantly greater diameter than the aperture of 16. Thus, it is seen that the apertures increase in diameter in a downstream direction away from the source of spent electron 11.

The end electrode plate 18 is preferably conical and has a spike extending from the apex toward the source of electrons 11. The electrodes 14 through 17 are preferably bowed toward the source of electrons 11 with the electrode plate closest to the source 11 being preferably a portion of a sphere whose center is at the apex of conical electrode 18.

Electrodes 15–17 may be considered as intermediate electrodes while electrode 14 is a first or beam entrance electrode. Electrode 18 is the last or downstream end electrode.

In accordance with the invention, at least one low power mode electrode 19 is axially positioned between intermediate electrode 17 and conical end electrode 18. The low power mode electrode 19, as shown, has a shallow, generally bowed, quasiconical shape and includes a central aperture which is preferably smaller but necessarily no larger than the aperture of the preceding upstream electrode 17.

Preferably, electrode 19 has surfaces parallel to conical end electrode 18 although configurations ranging from a flat plate to a shallow or deep cone are also operable to provide greater efficiency than obtainable in a collector without one or more low power mode electrodes. For maximum efficiency, an auxiliary low power mode electrode plate 20 is axially positioned between low power mode electrode 19 and conical end electrode 18 and includes a central aperture larger than that of electrode 19.

The diameter of the central aperture of low power mode electrode 19, the diameter of the central aperture of intermediate electrode 17, the taper of the spike of conical end electrode 18 and the diameter of the spike are all critically interrelated. While the aperture of low power mode electrode 19 must be no larger than the aperture of intermediate electrode 17, it must also be substantially larger than the diameter of the spike at the axial position of the aperture of electrode 19. The aperture of auxiliary low power mode electrode 20 must be substantially larger than that of low power mode electrode 19 but otherwise its diameter is not critical.

Preferably no more than one quarter of the length of the spike should extend through the aperture of low power mode electrode 19. More preferably the tip of the spike should lie at the same axial position as the aperture.

Suitable voltages for electrodes 14 through 20 are supplied from a voltage divider 21 which has a terminal 22 at one end connected to a source of negative potential (not shown). The other end of the voltage divider 21 is connected to a common current return path such as ground 23 with the collector assembly 10 also being grounded at 23. Cathode 13 of the TWT spent electron source 11 is connected via a lead 24 to the same point on voltage divider 21 as electrode 18. Electrodes 15, 16, 17, 19, 20 and 18 are connected to points 25, 26, 27, 28, 29 and 30, respectively, on the voltage divider 21.

During operation of the TWT 11 in a high power mode, electrons emitted by the cathode 13 interact with the structure of the TWT to generate radio frequency (RF) signals. These electrons which after interacting are "used" or "spent" are then injected into the collector 10 through the central aperture in electrode 14. The spent electrons have various transverse and axial energies and velocities and will fall back onto the rear surfaces of the electrodes 14 through 17.

Typical trajectories for electrons of the spent beam are indicated by the bunches of curved arrows shown in FIG. 1. According to the design of the collector 10, no spent electrons will pass through the central apertures of low power mode electrodes 19 and 20. In practice, some few fast electrons will pass through those apertures but will have substantially no effect on the operation of collector 10.

The spike extending from conical end electrode 18 serves to deflect electrons which have passed through the aperture of intermediate electrode 17 radially outwardly from an imaginary axis of the electron beam, which axis is depicted by the dash line 31.

Figure 2:
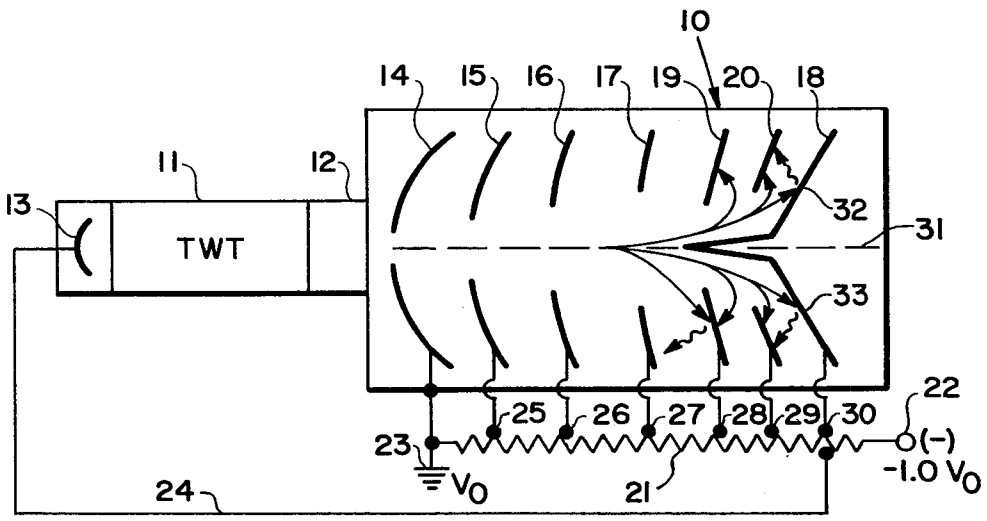
FIG. 2 is like FIG. 1 but illustrates the general path taken by spent electrons for a low power mode of operation.

Referring now to FIG. 2, there is shown schematically a multistaged depressed collector and traveling wave tube which is identical to that shown in FIG. 1. Parts in FIG. 2 are identified by the same numerals as corresponding parts in FIG. 1.

With reference to FIG. 2, the TWT 11 is operating in a low power mode and the beam of spent electrons injected into the collector assembly 10 is, therefore, comprised of electrons which have relatively high average energy, little axial velocity spread, small root mean square (RMS) beam angle and small annular spread. To achieve a reasonably high overall transmitter efficiently, that is the total efficiency of the traveling wave tube and the collector assembly combined, the efficiency of the multistage depressed collector must be well in excess of 90%, both for low power operation and high power operation. When the TWT 11 is operated in a low power mode, the spent electrons because of their particular energies and velocities, as discussed above, pass through the central apertures of low power mode electrode 19 and auxiliary low power mode electrode 20 and fall back onto their rear surfaces. Some of the electrons will strike the front surface of conical end electrode 18 as illustrated points 32 and 33 causing the emission of secondary electrons. The secondary electrons will be captured by auxiliary low power mode electrode 20.

Preferably, all electrodes 14–20 have surfaces which minimize secondary electron emission. Numerous material coatings and surfaces are known in the prior art and have various degrees of effectiveness in suppressing secondary emissions. The electrodes of the instant invention are preferably copper with a pyrolitic graphite coating. They provide both ample cooling and secondary emission suppression. At least the low power electrode or electrodes should be made of materials or have coatings with secondary emission suppressing characteristics. Preferred materials for electrodes or coatings are pyrolitic graphite, titaniun carbide, tungsten carbide and titanium diboride.

The electrodes 15, 16 and 17 are intermediate electrodes with respect to the first electrode 14 and end electrode 18. While a greater or lesser number of intermediate electrodes than shown in FIGS. 1 and 2 may be used, at least one intermediate electrode having an aperture of substantially greater diameter than the aperture of the first entrance electrode 14 is required. Also, in accordance with the invention, at least one low power mode electrode is required and has an aperture no larger than that of the nearest upstream intermediate electrode and preferably is smaller.

As discussed previously above, the relationship of the central apertures of electrodes 17, 19 and 20 as well as the taper and length of the spike of electrode 18, are critically interrelated. However, because these relationships are also dependent upon the voltages applied to the electrodes, the spacing of the electrodes and other parameters, specific dimensions cannot be calculated except where the particular spacing of the electrodes and the specific voltage applied to each is known.

It will be understood that those skilled in the art to which the invention pertains may make various changes and modifications to the above described invention without departing from the spirit and scope thereof as set forth in the claims appended hereto.

I claim:

1. In a microwave traveling wave transmitting tube (TWT) of the type having an electron emitting cathode, a depressed collector and having high power and low power modes of operation, said TWT serving as a source providing a beam of spent electrons whose trajectories diverge from the beam axis in a downstream direction from said source;

a collector for said electrons, said collector comprising:

a first beam entrance electrode, said first electrode having a central aperture and being bowed toward said source of spent electrons;

a conical end electrode downstream from said first electrode having a spike extending from its apex toward said source of electrons, said spike lying on said beam axis;

at least one intermediate electrode positioned between said first electrode and said conical end electrode and having a central aperture, said aperture being of greater diameter than the aperture of said first electrode, said intermediate electrode being bowed toward said source of spent electrons;

at least one low power mode electrode positioned between said intermediate electrode and said conical end electrode and having an aperture no larger than that of said intermediate electrode, and being axially positioned such that no more than about one-quarter of said spike extends through said aperture whereby most of said spent electrons pass between said spike and the edge of said aperture in said low power electrode when said tube is operated in said low power mode.

2. The collector of claim 1 and including a plurality of intermediate electrodes each having a central aperture, each aperture being larger than the preceding upstream aperture.

3. The collector of claim 1 wherein said spike extends more than half-way from the conical end electrode to the low power electrode along the axis of the spent electron beam.

4. The collector of claim 1 wherein the voltage on said low power mode electrode with respect to common is about 95% of that on the TWT cathode.

5. The collector of claim 1 wherein said entrance electrode is a portion of a sphere and said at least one intermediate electrode and said low power electrode are bowed toward said source of electrons.

6. The collector of claim 1 wherein the aperture in said low power mode electrode is about one-half the diameter of the aperture in said intermediate electrode.

7. The collector of claim 1 wherein said source of electrons is a TWT and including means for refocusing a spent electron beam from the TWT before it enters said collector.

8. The collector of claim 1 wherein at least said low power electrodes are of a low secondary yield material.

9. The collector of claim 1 wherein all electrodes are of a low secondary yield material.

10. The collector of claim 9 wherein at least the surfaces of said electrodes are of a material selected from the group consisting of pyrolitic graphite, titanium carbide, tungsten carbide and titanium diboride.

11. The collector of claim 1 wherein said spike has an included angle of between 10° and 20°.

12. The collector of claim 1 and including an auxiliary low power mode electrode axially positioned between said low power electrode and said end electrode and having a central aperture larger than that of said low power mode electrode.

13. The collector of claim 12 wherein said low power mode electrode and said auxiliary low power mode electrode are of conical configuration.

14. The collector of claim 12 wherein said low power mode electrode and said auxiliary low power mode electrode have surfaces which are parallel to the surfaces of said conical end electrode.

15. The collector of claim 12 and including a plurality of intermediate electrodes.

16. The collector of claim 12 wherein the tip of said spike is at approximately the same axial position as the central aperture in said low power mode electrode.

17. The collector of claim 12 wherein all of said electrodes have surfaces of a material selected from the group consisting of pyrolitic graphite, titanium carbide, tungsten carbide and titanium diboride.

18. The collector of claim 12 wherein the voltage on said low power mode electrode is about 95% of that on the TWT cathode.

19. The collector of claim 12 wherein said spike has an included angle of between about 10° and about 20°.

20. The collector of claim 12 wherein the aperture of the low power mode electrode is about one-half the diameter of the aperture of the intermediate electrode.

21. The collector of claim 20 wherein the spike length is such that its tip lies within the aperture of the low power mode electrode.

22. The electrode of claim 1 wherein the central aperture of said low power mode electrode is effectively smaller than the aperture of said intermediate electrode.

* * * * *